US006330751B1

(12) United States Patent
Seaman

(10) Patent No.: US 6,330,751 B1
(45) Date of Patent: Dec. 18, 2001

(54) DOCK LEVELER APPARATUS

(76) Inventor: Larry D. Seaman, HCR 2 Box 251, Pequot Lakes, MN (US) 56472

( * ) Notice: Subject to any disclaimer, the term of this patent is extended or adjusted under 35 U.S.C. 154(b) by 0 days.

(21) Appl. No.: 09/179,101

(22) Filed: Oct. 27, 1998

Related U.S. Application Data

(60) Provisional application No. 60/067,736, filed on Dec. 2, 1997.

(51) Int. Cl.[7] ..... B43L 7/12

(52) U.S. Cl. ..... 33/465; 19/69.5

(58) Field of Search ..... 33/42, 479, 481, 33/425, 428, 474, 476, 480, 468, 469, 470, 467, 451, 452, 465, 458; 14/69.5, 71.1

(56) References Cited

U.S. PATENT DOCUMENTS

| | | | | |
|---|---|---|---|---|
| 244,754 | * | 7/1881 | Kirkham | 33/470 |
| D. 333,991 | * | 3/1993 | Lee | D10/62 |
| 339,158 | * | 4/1886 | Finley | 33/451 |
| 557,804 | | 4/1896 | Hammers et al. . | |
| 596,818 | * | 1/1898 | Moore | 33/451 |
| 733,570 | * | 7/1903 | Victor | 33/451 |
| 794,071 | * | 7/1905 | Barbow | 33/458 |
| 992,722 | * | 5/1911 | Lindstrom | 33/451 |
| 1,082,626 | | 12/1913 | Foerst . | |
| 1,137,169 | * | 4/1915 | Rudolff | 33/451 |
| 1,841,972 | * | 1/1932 | Mosley . | |
| 2,878,569 | * | 3/1959 | Metrulis | 33/451 |
| 3,398,449 | | 8/1968 | Dolgorukov . | |
| 3,499,225 | * | 3/1970 | Darran | 33/480 |
| 3,522,657 | * | 8/1970 | Metrulis | 33/451 |
| 3,885,315 | * | 5/1975 | Polselli et al. | 33/42 |
| 4,194,295 | * | 3/1980 | Simuro et al. | 33/451 |
| 4,327,501 | * | 5/1982 | Hurt | 33/451 |
| 4,394,801 | * | 7/1983 | Thibodeaux | 33/451 |
| 4,574,492 | * | 3/1986 | Miller | 33/427 |
| 4,947,551 | * | 8/1990 | Deisch | 30/161 |
| 5,103,570 | | 4/1992 | Nichols | 33/479 |
| 5,421,093 | * | 6/1995 | Davidson, Jr. | 33/42 |
| 5,438,761 | * | 8/1995 | Krumszyn et al. | 33/451 |
| 5,450,643 | | 9/1995 | Warner | 14/69.5 |
| 5,456,015 | * | 10/1995 | Butcher et al. | 33/451 |
| 5,586,395 | * | 12/1996 | Malczewski | 33/451 |
| 5,621,390 | * | 4/1997 | Neal | 340/584 |
| 5,915,806 | * | 6/1999 | Levee | 33/42 |

FOREIGN PATENT DOCUMENTS

| | | | | |
|---|---|---|---|---|
| 12070 | * | of 1912 | (GB) | 33/452 |
| 519637 | * | 4/1940 | (GB) | 33/451 |
| 30008 | * | 8/1925 | (NL) | 33/42 |
| 102437 | * | 8/1925 | (NL) | 33/42 |

* cited by examiner

*Primary Examiner*—Diego Gutierrez
*Assistant Examiner*—Gail Verbitsky

(57) ABSTRACT

A dock leveler apparatus includes a base member which is floatable on water, and the base member includes a planar base bottom surface. A ruler member is connected to the base member. The ruler member includes a planar ruler bottom edge which is perpendicular to the base bottom surface, and the ruler member includes indicia of linear length. When the base bottom surface is placed on a dock surface and when the ruler member projects perpendicularly downward from the dock surface, the indicia on the ruler member can be used for setting the dock surface at a desired level. When the dock leveler apparatus is employed, a dock level adjustment assembly can be used to make adjustments to the height or level of the dock surface. The base member is made sufficiently large so that if the dock leveler apparatus falls into the water, the entire apparatus will float in the water. The water-floatable base member can be made from a hollow shell. Also, the base member can be made from a material less dense than water such as a plastic foam. One or more magnets are attached to a side wall of the base member. A handle is attached to a top wall of the base member. The base member includes a hanger receiver. In accordance with another aspect of the invention, a pivot assembly, which includes ruler orientation locks, is interconnected between the ruler member and the base member.

8 Claims, 6 Drawing Sheets

FIG 5
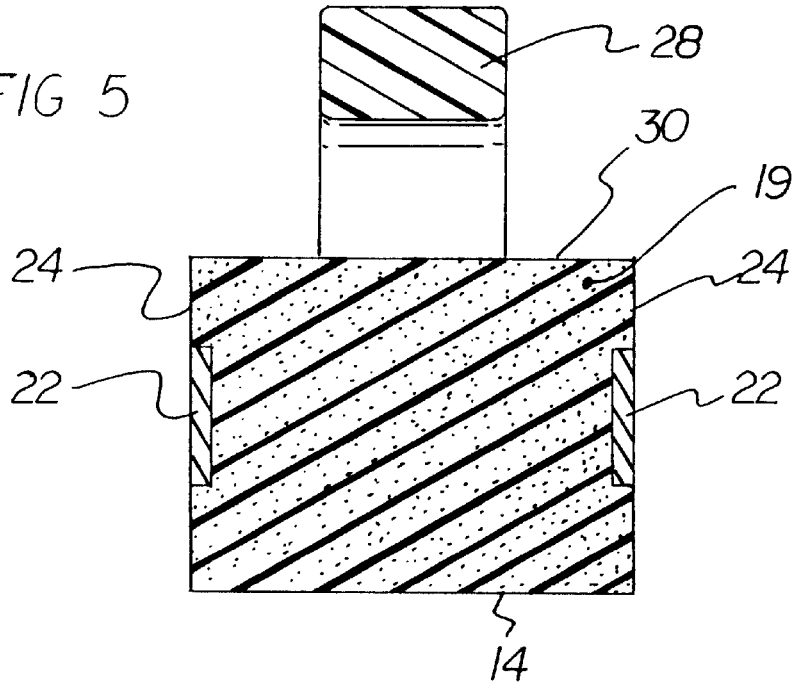
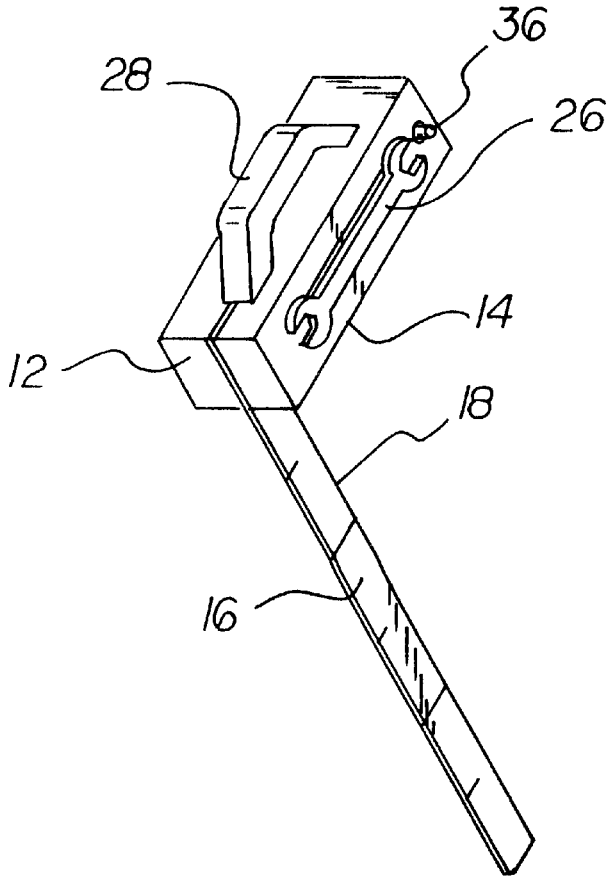
FIG 6

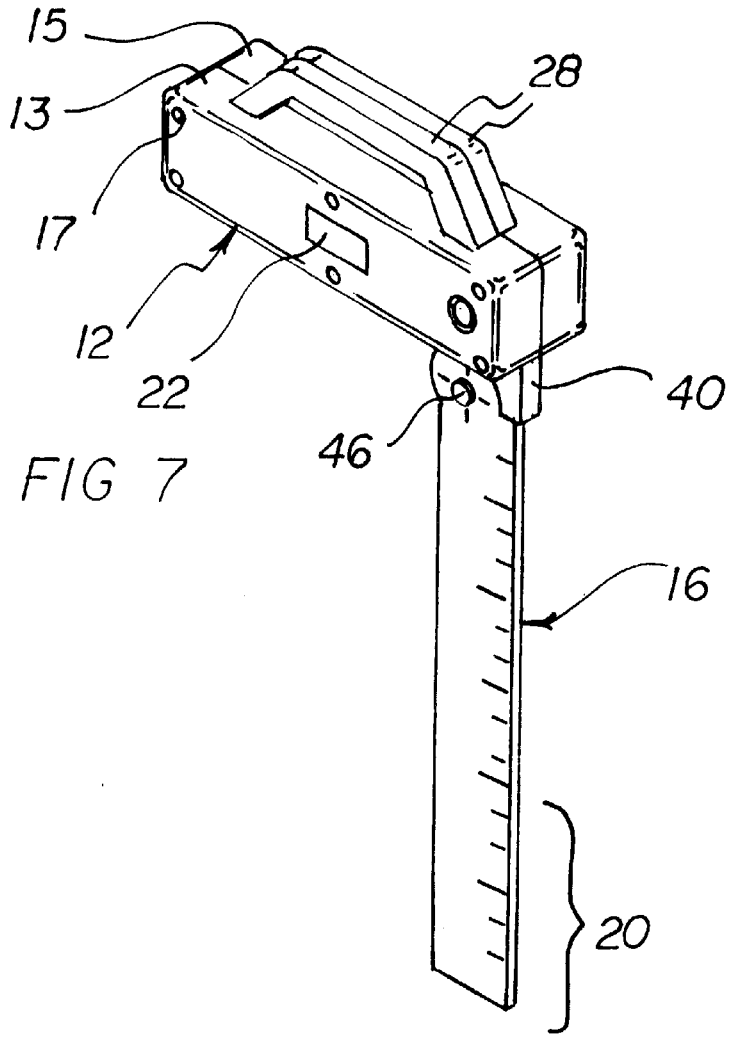
FIG 7
FIG 8
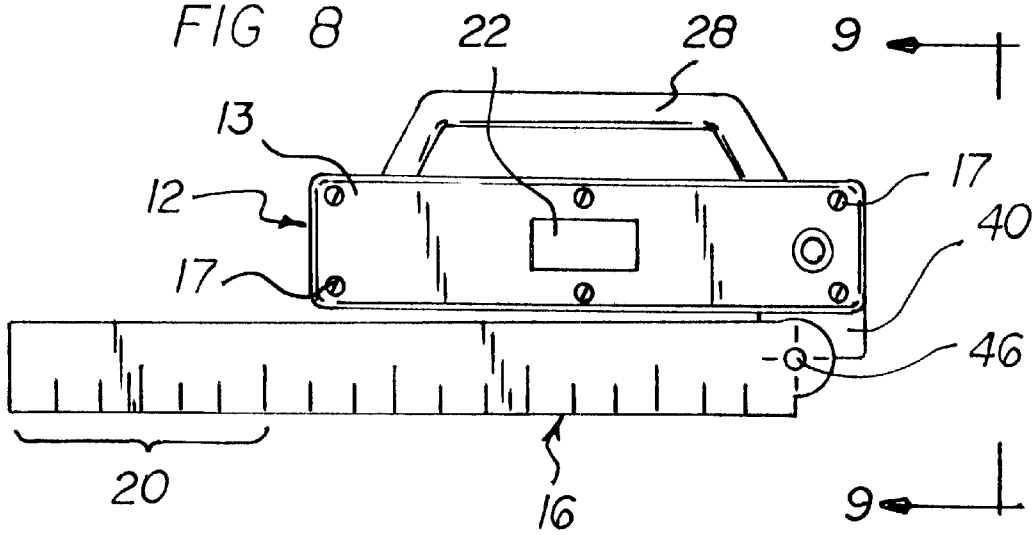

DOCK LEVELER APPARATUS

CROSS-REFERENCE TO RELATED APPLICATION

This application claims priority based upon my prior copending Provisional Application Ser. No. 60/067,736, filed Dec. 2, 1997.

BACKGROUND OF THE INVENTION

1. Field of the Invention

The present invention relates generally to leveling devices, and, more particularly, to leveling devices especially adapted for leveling docks.

2. Description of the Prior Art

It is well known to use conventional T-squares for orienting one object to be perpendicular to another object. Exemplary T-squares are disclosed in U.S. Pat. Nos. 557, 804, 1,082,626, 3,398,449, and 5,103,570. However, for purposes of leveling docks, none of those T-squares has a readily accessible handle that can be used to hold the T-square in a vertical orientation as the dock is being leveled. In this respect, it would be desirable if a device for leveling a dock had a handle that is readily accessible to hold the device in a vertical orientation as the device is being used.

Another problem associated with the use of conventional T-squares in leveling a dock relates to what may happen if a T-square falls into the water. Were this to occur, the T-square may sink if not made from buoyant materials. In this respect, it would be desirable if a device for leveling a dock were provided that is made from buoyant material that floats in water. Further, if the dock leveling device were to fall into water, it would be desirable if the device were designed so that a handle is oriented upward as the device floats in the water.

Turning to U.S. Pat. No. 5,450,643, this patent may be of interest for its disclosure of an inflatable bag structure used for leveling a dock. In this respect, it would be desirable if a device for leveling a dock did not include complex inflatable structures.

Still other features would be desirable in a dock leveler apparatus. For example, for purposes of retaining iron-based metal tools, it would be desirable if a dock leveler apparatus included a magnet for attracting an iron-based tool.

Also, for purposes of hanging the dock leveler apparatus up on a wall when not in use, it would be desirable if a device for leveling a dock included a channel allowing the device to be hung on a wall-mounted nail.

For purposes of storage, it would be desirable if a ruler member of a dock leveler apparatus could be oriented parallel to a base member of the apparatus. Further, in this respect, it would be desirable if a dock leveler apparatus had means for locking the ruler member into either a perpendicular orientation or a parallel orientation with respect to the base member.

Thus, while the foregoing body of prior art indicates it to be well known to use T-squares for general leveling purposes, the prior art described above does not teach or suggest a dock leveler apparatus which has the following combination of desirable features: (1) has a handle that is readily accessible to hold the device in a vertical orientation as the device is being used for leveling a dock; (2) is made from buoyant material that floats in water; (3) has a handle that is oriented upward as the device floats in the water; (4) does not include complex inflatable structures; (5) includes a magnet for attracting and holding thereto an iron-based tool; (6) includes a channel allowing the device to be hung on a wall-mounted nail; (7) includes a pivot assembly so that a ruler member can be oriented parallel to a base member, and (8) has means for locking the ruler member into either a perpendicular orientation or a parallel orientation with respect to the base member. The foregoing desired characteristics are provided by the unique dock leveler apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a dock leveler apparatus which includes a base member which is floatable on water, and the base member includes a planar base bottom surface. A ruler member is connected to the base member. The ruler member includes a planar ruler bottom edge which is perpendicular to the base bottom surface, and the ruler member includes indicia of linear length. When the base bottom surface is placed on a dock surface and when the ruler member projects downward from the dock surface, the indicia on the ruler member can be used for setting the dock surface at a desired level. When the dock leveler apparatus is employed, a dock level adjustment assembly can be used to make adjustments to the height or level of the dock surface. The base member is made sufficiently large so that if the dock leveler apparatus falls into the water, the entire apparatus will float in the water.

The water-foatable base member can be made from a hollow shell. Also, the base member can be made from a material less dense than water such as a plastic foam. One or more magnets are attached to a side wall of the base member. A handle is attached to a top wall of the base member. The base member includes a hanger receiver.

In accordance with other aspects of the invention, the base member includes a first base member portion, a second base member portion, and base member fasteners for connecting the first base member portion to the second base member portion.

In accordance with yet another aspect of the invention, a pivot assembly is interconnected between the ruler member and the base member. The pivot assembly includes a pivot pin support member connected to the base member. The pivot pin support member includes a first pivot pin reception aperture, a second pivot pin reception aperture in the ruler member, and a pivot pin member received in the first pivot pin reception aperture and the second pivot pin reception aperture when the first pivot pin reception aperture and the second pivot pin reception aperture are placed in registration. The pivot pin member includes transversely biased pivot pin portions.

The pivot assembly further includes ruler orientation locks located between the pivot pin support member and the ruler member. The ruler orientation locks include lock bumps located on the ruler member and bump reception wells located on the pivot pin support member.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least two preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved dock leveler apparatus which has all of the advantages of the prior art and none of the disadvantages.

It is another object of the present invention to provide a new and improved dock leveler apparatus which may be easily and efficiently manufactured and marketed.

It is a further object of the present invention to provide a new and improved dock leveler apparatus which is of durable and reliable construction.

An even further object of the present invention is to provide a new and improved dock leveler apparatus which is susceptible of a low cost of manufacture with regard to both materials and labor, and which accordingly is then susceptible of low prices of sale to the consuming public, thereby making such dock leveler apparatus available to the buying public.

Still yet a further object of the present invention is to provide a new and improved dock leveler apparatus which has a handle that is readily accessible to hold the device in a vertical orientation as the device is being used for leveling a dock.

Still another object of the present invention is to provide a new and improved dock leveler apparatus that is made from buoyant material that floats in water.

Yet another object of the present invention is to provide a new and improved dock leveler apparatus which has a handle that is oriented upward as the device floats in the water.

Even another object of the present invention is to provide a new and improved dock leveler apparatus that does not include complex inflatable structures.

Still a further object of the present invention is to provide a new and improved dock leveler apparatus which includes a magnet for attracting and holding thereto an iron-based tool.

Yet another object of the present invention is to provide a new and improved dock leveler apparatus that includes a channel allowing the device to be hung on a wall-mounted nail.

Still another object of the present invention is to provide a new and improved dock leveler apparatus which includes a pivot assembly so that a ruler member can be oriented parallel to a base member.

Yet another object of the present invention is to provide a new and improved dock leveler apparatus that has means for locking the ruler member into either a perpendicular orientation or a parallel orientation with respect to the base member.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 5 is a cross-sectional view of the portion of the embodiment of the invention shown in FIG. 4 taken along line 5—5 thereof.

FIG. 6 is a perspective view of the first embodiment of the invention shown supporting a hand tool on a magnetic strip and being supported on a wall by a hanger portion.

FIG. 7 shows a perspective view of a second embodiment of the invention in which a pivot assembly is provided between the base member and the ruler member, and in which the ruler member is oriented perpendicular to the base member.

FIG. 8 is a side view of the second embodiment of the invention shown in FIG. 7 in which the ruler member is oriented parallel to the base member.

DESCRIPTION OF THE PREFERRED EMBODIMENT

With reference to the drawings, two embodiments of a new and improved dock leveler apparatus embodying the principles and concepts of the present invention will be described.

Figure 1:
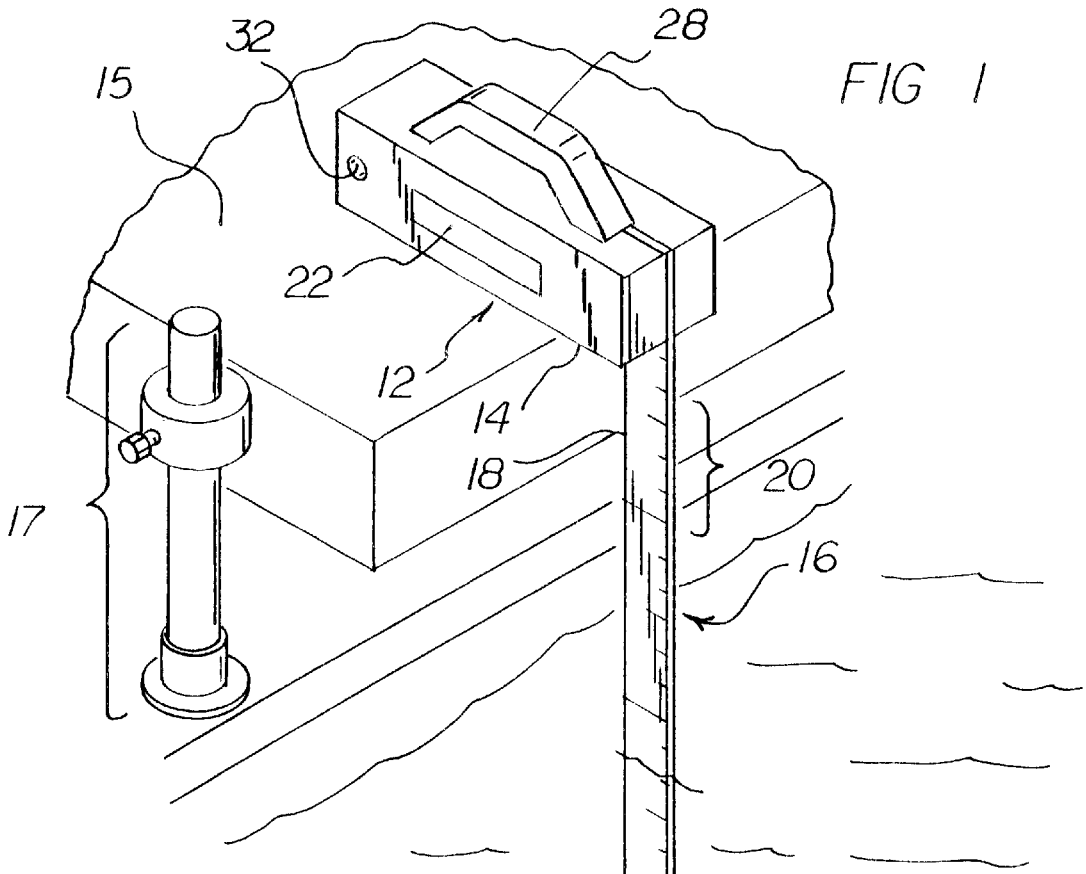
FIG. 1 is a perspective view showing a first embodiment of the dock leveler apparatus of the invention in use on a dock that can be leveled.
Figure 2:
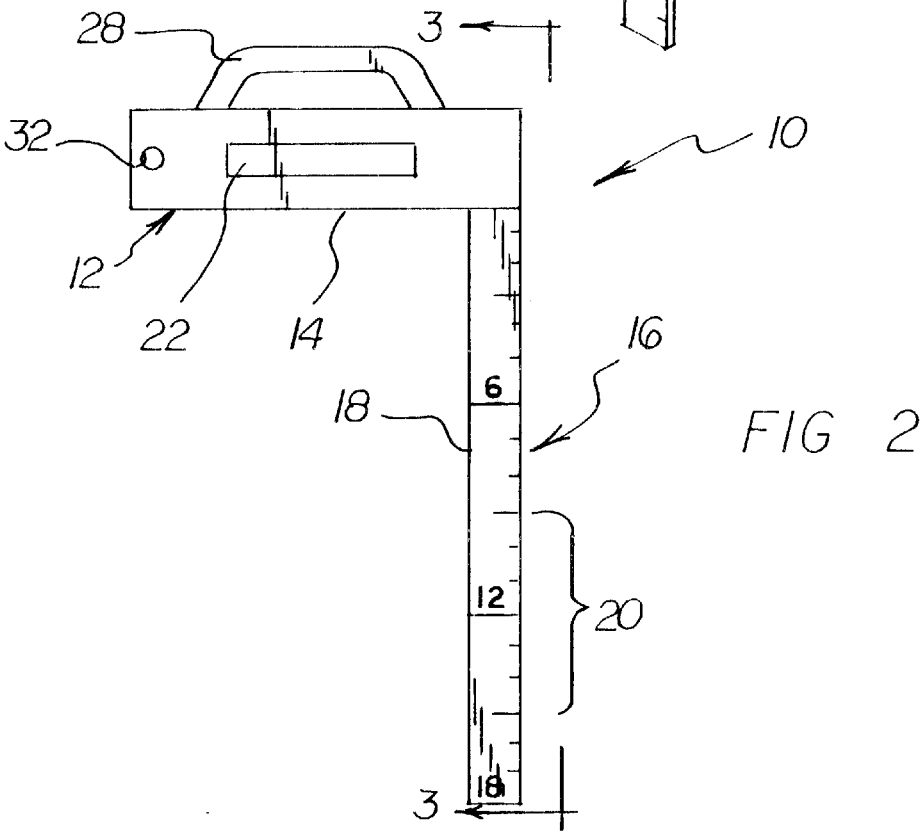
FIG. 2 is a side view of the embodiment of the dock leveler apparatus shown in FIG. 1 removed from the dock.
Figure 3:
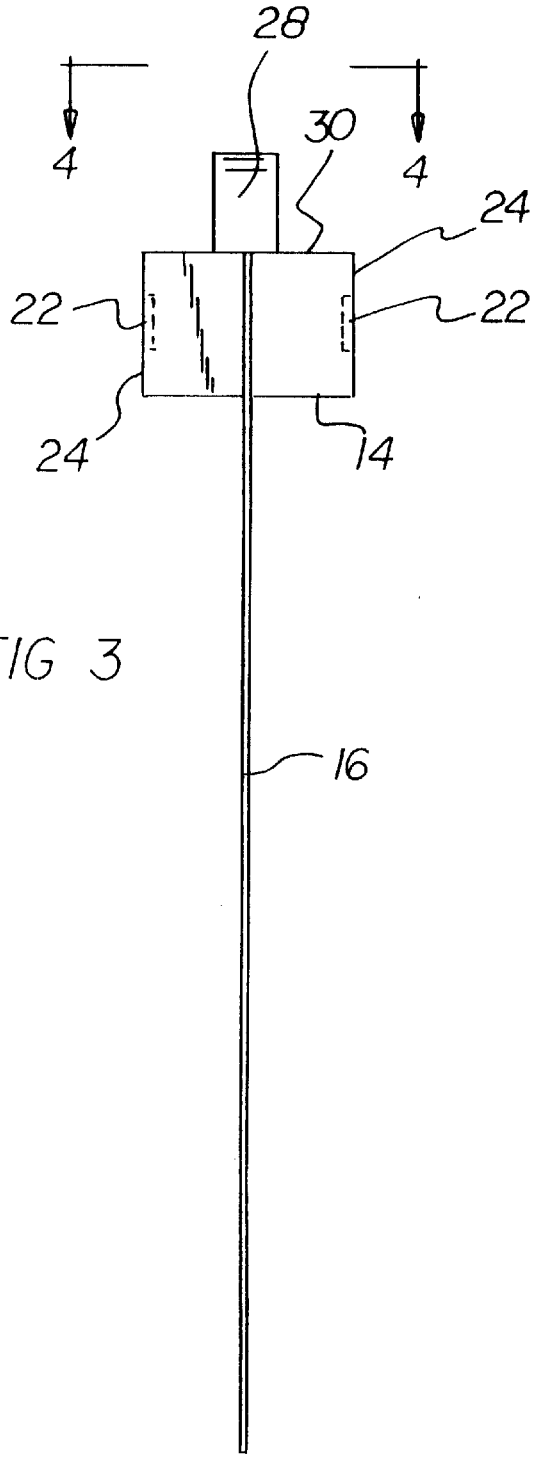
FIG. 3 is an enlarge edge view of the embodiment of the dock leveler apparatus of FIG. 2 taken along line 3—3 thereof.
Figure 4:
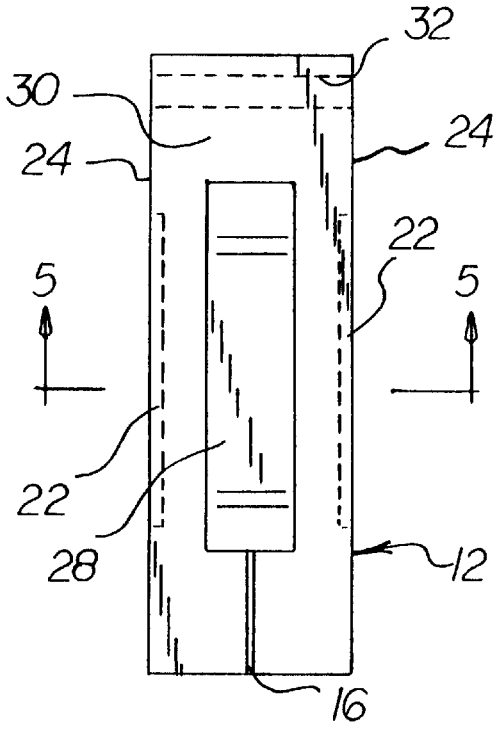
FIG. 4 is a top view of the embodiment of the invention shown in FIG. 3 taken along line 4—4 thereof.
Figure 9:
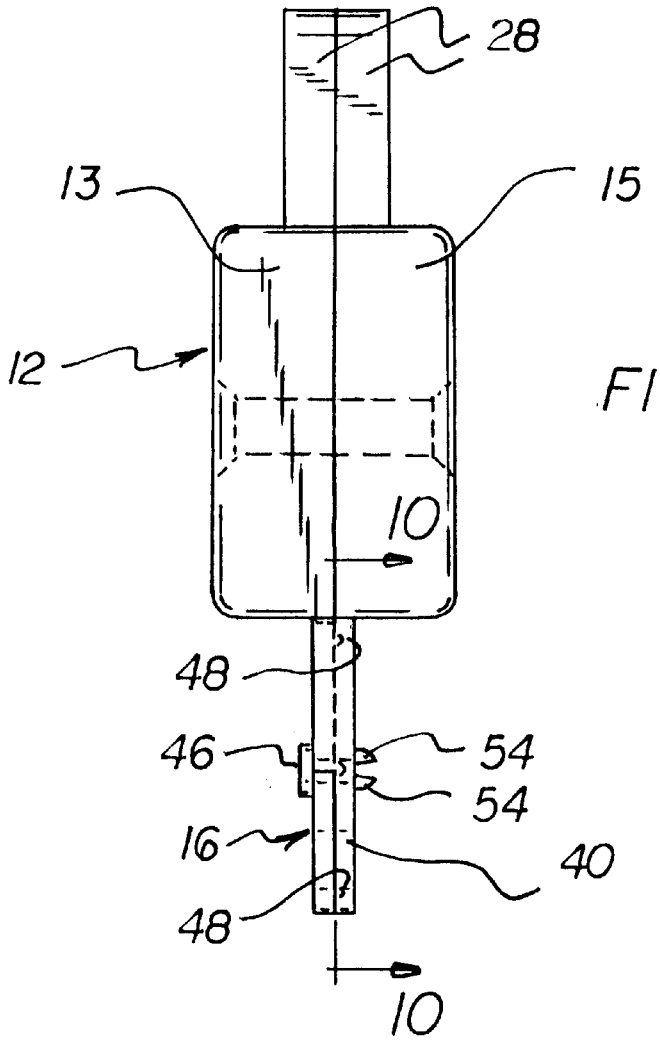
FIG. 9 is a front edge view of the embodiment of the invention shown in FIG. 8 taken along line 9—9 thereof.
Figure 10:
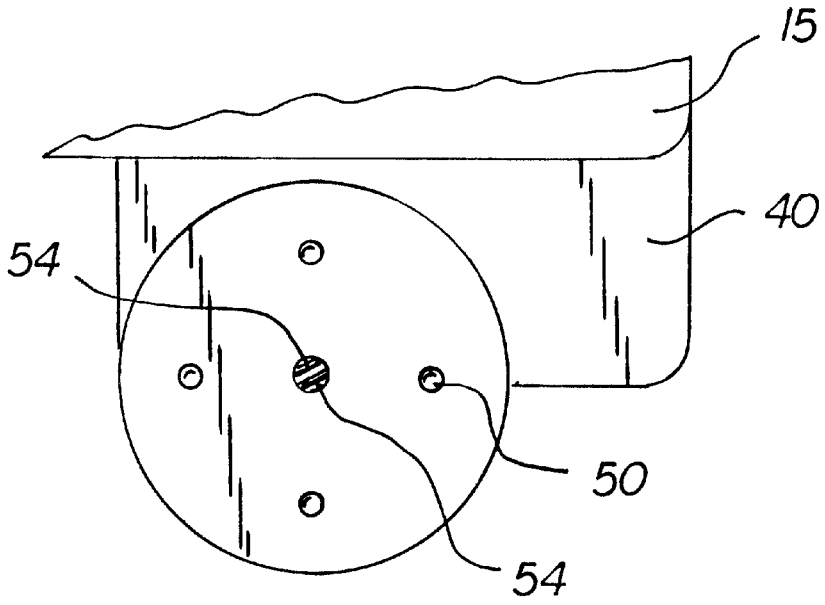
FIG. 10 is an enlarged cross-sectional view of the portion of the embodiment of the invention shown in FIG. 9 taken along line 10—10 thereof.
Figure 11:
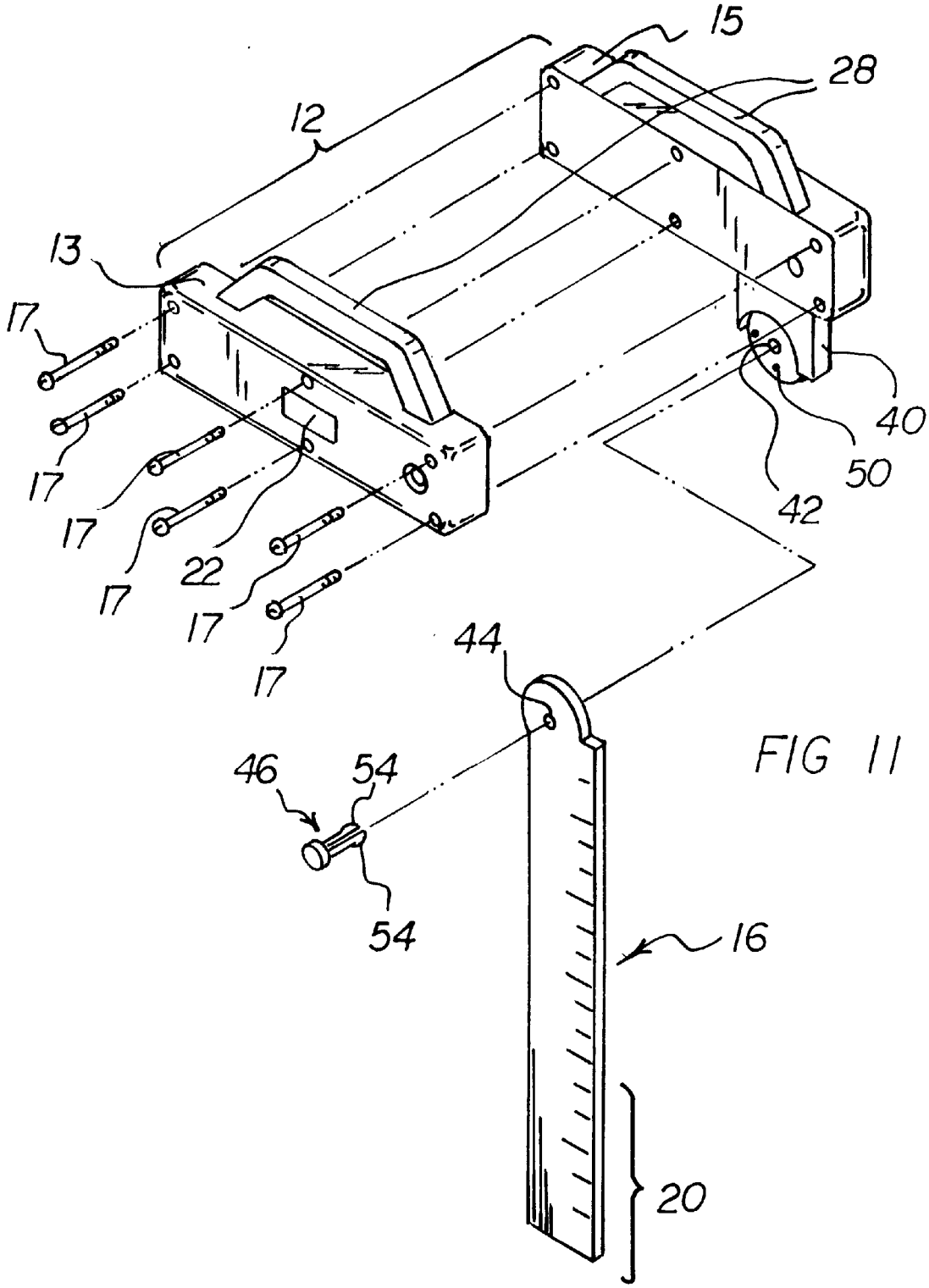
FIG. 11 is an exploded perspective view of the second embodiment of the invention.

Turning to FIGS. 1–6, there is shown first embodiment of the dock leveler apparatus of the invention generally designated by reference numeral 10. In its preferred form, dock leveler apparatus 10 includes a base member 12 which is floatable on water, and the base member 12 includes a planar base bottom surface 14. A ruler member 16 is connected to the base member 12. The ruler member 16 includes a planar ruler bottom edge 18 which is perpendicular to the base bottom surface 14, and the ruler member 16 includes indicia 20 of linear length. When the base bottom surface 14 is placed on a dock surface 15 and when the ruler member 16 projects downward from the dock surface 15, the indicia 20 on the ruler member 16 can be used for setting the dock surface 15 at a desired level. More specifically, the indicia 20 on the ruler member 16 can be used to show the distance from the dock surface 15 to the water. As shown in FIG. 1, a dock level adjustment assembly 17 can be used to make adjustments to the height or level of the dock surface 15. More specifically, a dock level adjustment assembly 17 is provided on each side of the dock surface 15 so that the dock level adjustment assemblies 17 can be adjusted to level the dock. This procedure can be repeated for each dock section. The base member 12 is made sufficiently large so that if the dock leveler apparatus 10 falls into the water, the entire apparatus will float in the water.

The water-floatable base member 12 can be made from a hollow shell. Also, the base member 12 can be made from a material less dense than water such as a plastic foam 19. The plastic foam 19 can be placed inside a hollow shell. One or more magnets 22, which can be in the form of magnet strips, are attached to a side wall 24 of the base member 12. The magnets 22 can he used for retaining metallic hand tools, such as wrench 26 shown in FIG. 6. Handle 28 is attached to a top wall 30 of the base member 12.

The base member 12 includes a hanger receiver 32. As shown in the drawings, the hanger receiver 32 can be a reception channel 32 in the base member 12. As shown in FIG. 6, the dock leveler apparatus 10 is hung on a wall peg 36. With a magnet 22 and a handle 28 present on the base member 12 and with a hand tool attached to the magnet 22, the floatable base member 12 is made sufficiently large so that if the dock leveler apparatus 10 falls into the water, the entire apparatus will float on the water.

As shown in FIGS. 7–11, in accordance with a second embodiment of the invention, the base member 12 includes a first base member portion 13, a second base member portion 15, and base member fasteners 17 for connecting the first base member portion 13 to the second base member portion 15. A pivot assembly is interconnected between the ruler member 16 and the base member 12.

Further, in accordance with the second embodiment of the invention, the pivot assembly includes a pivot pin support member 40 connected to the base member 12. The pivot pin support member 40 includes a first pivot pin reception aperture 42, a second pivot pin reception aperture 44 in the ruler member 16, and a pivot pin member 46 received in the first pivot pin reception aperture 42 and the second pivot pin reception aperture 44 when the first pivot pin reception aperture 42 and the second pivot pin reception aperture 44 are placed in registration. The pivot pin member 46 includes transversely biased pivot pin portions 54. When the first pivot pin reception aperture 42 of the pivot pin support member 40 and the second pivot pin reception aperture 44 of the ruler member 16 are placed in registration, the pivot pin member 46 is inserted through those apertures, and the pivot pin portions 54 of the pivot pin member 46 snap transversely to lock the pivot pin member 46 into position.

The pivot assembly further includes ruler orientation locks located between the pivot pin support member 40 and the base member 12. The ruler orientation locks include lock bumps 48 located on the ruler member 16 and bump reception wells 50 located on the pivot pin support member 40.

In using the second embodiment of the invention, as shown in FIG. 7, the ruler member 16 is oriented perpendicular to the base member 12. In this orientation, the lock bumps 48 are in engagement with the bump reception wells 50 to lock the ruler member 16 perpendicular to the base member 12. The resilient nature of the pivot pin portions 54 help urge the lock bumps 48 into engagement with the bump reception wells 50. In contrast, as shown in FIG. 8, the ruler member 16 is oriented parallel to the base member 12. Once again, the lock bumps 48 are in engagement with the bump reception wells 50 to lock the ruler member 16 parallel to the base member 12.

The components of the dock leveler apparatus of the invention can be made from inexpensive and durable rust resistant or rust proof metal and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved dock leveler apparatus that is low in cost, relatively simple in design and operation, and which may advantageously have a handle that is readily accessible to hold the apparatus in a vertical orientation as the apparatus is being used for leveling a dock. With the invention, a dock leveler apparatus is provided which is made from buoyant material that floats in water. With the invention, a dock leveler apparatus is provided which has a handle that is oriented upward as the device floats in the water. With the invention, a dock leveler apparatus is provided which does not include complex inflatable structures. With the invention, a dock leveler apparatus is provided which includes a magnet for attracting and holding thereto an iron-based tool. With the invention, a dock leveler apparatus is provided which includes a channel allowing the device to be hung on a wall-mounted nail. With the invention, a dock leveler apparatus is provided which includes a pivot assembly so that a ruler member can be oriented parallel to a base member. With the invention, a dock leveler apparatus is provided which has means for locking the ruler member into either a perpendicular orientation or a parallel orientation with respect to the base member.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the annexed Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the United States is as follows:

1. A dock leveler apparatus, comprising:

a base member, wherein said base member includes a top wall, a pair of opposed ends and a planar base bottom surface, a ruler member connected to said base member, said ruler member having a first end and a second, remotely opposed end, said ruler member first end being connected to said base member planar base bottom surface proximal to one of said opposed ends of said base member, wherein said ruler member includes a first planar ruler edge and a second planar ruler edge extending parallel to said planar ruler first edge and spaced a predetermined distance from said planar ruler first edge, wherein said ruler member includes a plurality of measurement indicia along its length between said planar ruler first edge and said planar ruler second edge, and a handle attached to said top wall of said base member, wherein said apparatus further includes a pivot assembly interconnected between said ruler member and said base member, said pivot assembly comprising a pivot pin support member and a pivot pin, said pivot pin support member extending downwardly from said base member planar bottom surface proximal to one of said opposed ends of said base member, said pivot pin extending through said ruler member and said pivot pin support member to define a pivot axis located below said bottom surface of said base member, said ruler member being adapted to be rotatable about said pivot axis from a first operative position wherein said ruler first edge and said ruler second edge are oriented perpendicular to said base member planar bottom surface with said ruler member second edge being in alignment with said one of said opposed ends of said base member, and to a second inoperative position wherein said ruler member first edge and said ruler member second edge are oriented parallel to said base member planar bottom surface, said predetermined distance between said ruler member first end and said ruler member second end being greater than the longitudinal distance between said pair of opposed ends of said base member such that said ruler member second end extends beyond the other opposed end of said base member when said ruler member is in said second inoperative position, wherein said pivot pin support member includes a first pivot pin reception aperture, a second pivot pin reception aperture being provided in said ruler member first end, and a pivot pin member received in said first pivot pin reception aperture and said second pivot pin reception aperture when said first pivot pin reception aperture and said second pivot pin reception aperture are placed in registration, and wherein at said base member and said handle member are of material less dense than water such that said apparatus is floatable in water when said ruler member is either in said operative position or said inoperative position.

2. The apparatus of claim 1 wherein said water-floatable base member is made from a hollow shell.

3. The apparatus of claim 1 wherein said material less dense than water is a plastic foam.

4. The apparatus of claim 1 wherein said base member includes:

a first base member portion, a second base member portion, and base member fasteners for connecting said first base member portion to said second base member portion.

5. The apparatus of claim 1 wherein said base member includes a hanger receiver.

6. The apparatus of claim 1 wherein said pivot pin member includes transversely biased pivot pin portions.

7. The apparatus of claim 1 wherein said pivot assembly further includes:

ruler orientation locks located between said pivot pin support member and said ruler member.

8. The apparatus of claim 7 wherein said ruler orientation locks include:

lock bumps located on said ruler member, and bump reception wells located on said pivot pin support member.

* * * * *